US006535704B1

(12) United States Patent
Hoyt, III et al.

(10) Patent No.: US 6,535,704 B1
(45) Date of Patent: Mar. 18, 2003

(54) UPGRADEABLE AND EASILY SERVICEABLE IMAGING SYSTEMS WITH A REMOVABLE MODULE AND METHODS FOR USING THE SAME

(75) Inventors: Hazen L. Hoyt, III, Costa Mesa, CA (US); Jian Wen, Irvine, CA (US)

(73) Assignee: Aetas Technology, Incorporated, Irvine, CA (US)

( * ) Notice: Subject to any disclaimer, the term of this patent is extended or adjusted under 35 U.S.C. 154(b) by 0 days.

(21) Appl. No.: 09/717,325

(22) Filed: Nov. 20, 2000

(51) Int. Cl.[7] ..... G03G 15/02; G03G 15/00
(52) U.S. Cl. ..... 399/116; 399/118
(58) Field of Search ..... 399/110, 113, 399/116, 117, 118, 111; 347/115

(56) References Cited

U.S. PATENT DOCUMENTS 4,344,700 A * 8/1982 Kasama et al. ..... 399/117
4,757,344 A * 7/1988 Idenawa et al. ..... 399/113
5,722,013 A * 2/1998 Nagase et al. ..... 399/117 X
5,752,137 A * 5/1998 Haneda ..... 399/113 X
5,758,243 A * 5/1998 Haneda et al. ..... 399/117 X

* cited by examiner

*Primary Examiner*—Sandra Brase
(74) *Attorney, Agent, or Firm*—Sonnenschein Nath & Rosenthal

(57) ABSTRACT

An imaging system including a plurality of developing stations for developing an image on a sheet, a releasably removable image receiving module having at least one exposing unit and an image receiving substrate and a support structure for receiving the releasably removable image receiving module. The releasably removable image receiving module is configured to engage the support structure of the system such that the image receiving substrate of the module can be disposed in an operative relationship with the developing stations when the removable module is engaged with the support structure. This imaging system provides a method for upgrading, downgrading or modifying the imaging system that could be substantially performed by an end user. This imaging system may be embodied in a monocolor or multicolor printer, copier, facsimile machine or other electrophotographic based apparatus.

14 Claims, 6 Drawing Sheets

UPGRADEABLE AND EASILY SERVICEABLE IMAGING SYSTEMS WITH A REMOVABLE MODULE AND METHODS FOR USING THE SAME

BACKGROUND OF THE INVENTION

1. Field of the Invention

The present invention relates to an image forming apparatus such as an electrophotographic copier, printer or the like and, in particular, to a system and method for providing a simplified upgrade path for a color image forming apparatus.

2. Background Art

Electrophotographic imaging (or xerography) is a well known method of copying or otherwise printing documents. In general, electrophotographic imaging uses a charge-retentive, photosensitive surface (known as a photoreceptor), that is initially charged uniformly. The photoreceptor is then exposed to a light image representation of a desired image that discharges specific areas of the photoreceptor surface creating a latent image. Dry toner powder is applied to the latent image, forming a developed image. This developed image is then transferred from the photoreceptor to a substrate (e.g. paper, transparency, and the like) generally by the use of electrostatic attraction between the charged toner particles and oppositely charged ions sprayed on the substrate by a transfer charger.

This electrophotographic process can be used to produce color images by repeating the above-described process for each color of toner used. This approach is referred to a tone-on-tone (or "image-on-image") color accumulation approach. In the general case of a tone-on-tone electrophotographic apparatus, the device includes a photoreceptor (belt or drum), a series of four print stations (e.g. yellow, magenta, cyan and black), a transfer charger, some means for placing the substrate (paper or otherwise) between the photoreceptor and transfer charger and some means for fixing the positive toner image on the substrate. The photoreceptor is supported and generally driven to rotate such that each part of the photoreceptor is brought into operable registration with the print stations and transfer charger.

Each of the four print station generally includes three components: a charger, a light exposure device and a developer. The operation and interaction of each print station is generally the same. The charger charges the image area of the photoreceptor uniformly. (The charger can be any device capable of setting up a uniform electric field on the order of 500 volts magnitude on the photoreceptor, such as an AC or DC corotron, scorotron, dicorotron, a discorotron, a pin scorotron.)

The light source (any coherent light source, such as a laser or light emitting diode "LED") selectively exposes the photoreceptor to a modulated light causing the photoreceptor charge to dissipate wherever light falls. By controlling the light beam and its scan path the latent image is created. The developer provides toner having a charge opposite to that of the photoreceptor. The developers used in tone-on-tone processes have no physical contact with the photoreceptor because such contact would disturb previously deposited toner.

The various toners which accumulate on the photoreceptor are transferred from the photoreceptor to substrate by operation of transfer charger. In particular, a substrate is placed between the photoreceptor and transfer charger by a drive means, the transfer charger sprays ions having a charge opposite to that of the toner—on the back of the substrate to attract the toner onto the substrate. The resulting image is then fixed on to the substrate by way of a fuser unit or other fixing device and the substrate is fed into an output tray.

Unfortunately, these color capable electrophotographic systems tend to be expensive to produce because of the quantity and complexity of the components. As a result, these types of systems are only available to wealthier businesses that can afford the high cost. At present, attempts to solve this problem include new electrophotographic systems that only use one or two print stations to produce the color image at a lower cost. However, this approach is not a highly desirable solution because the speed of the processing increases when fewer print stations are utilized because the photoreceptor must then perform multiple passes for each color. Therefore, there is a need for an electrophotographic imaging system that is both quick and affordable.

Similarly, color capable electrophotographic systems have been more expensive and time consuming to repair than monochrome systems. The additional parts result in more frequent problems and require availability of greater replacement parts. In some cases, this leads to increase time before repair service is even available for a businesses. Consequently, there is a need for an electrophotographic imaging system that provides for quicker repair.

SUMMARY OF THE DISCLOSURE

A number of technical advances are achieved in the art, by implementation of an imaging system including a plurality of developing stations for developing an image on a sheet, a releasably removable image receiving module having at least one exposing unit and an image receiving substrate and a support structure for receiving the releasably removable image receiving module. The releasably removable image receiving module is configured to engage the support structure of the system such that the image receiving substrate of the module can be disposed in an operative relationship with the developing stations when the removable module is engaged with the support structure.

This imaging system provides a method for upgrading, downgrading or modifying the imaging system that could be substantially performed by an end user.

This imaging system may be embodied in a monocolor or multicolor printer, copier, facsimile machine or other electrophotographic based apparatus.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

BEST MODES OF PRACTICING THE INVENTION

Figure 1:
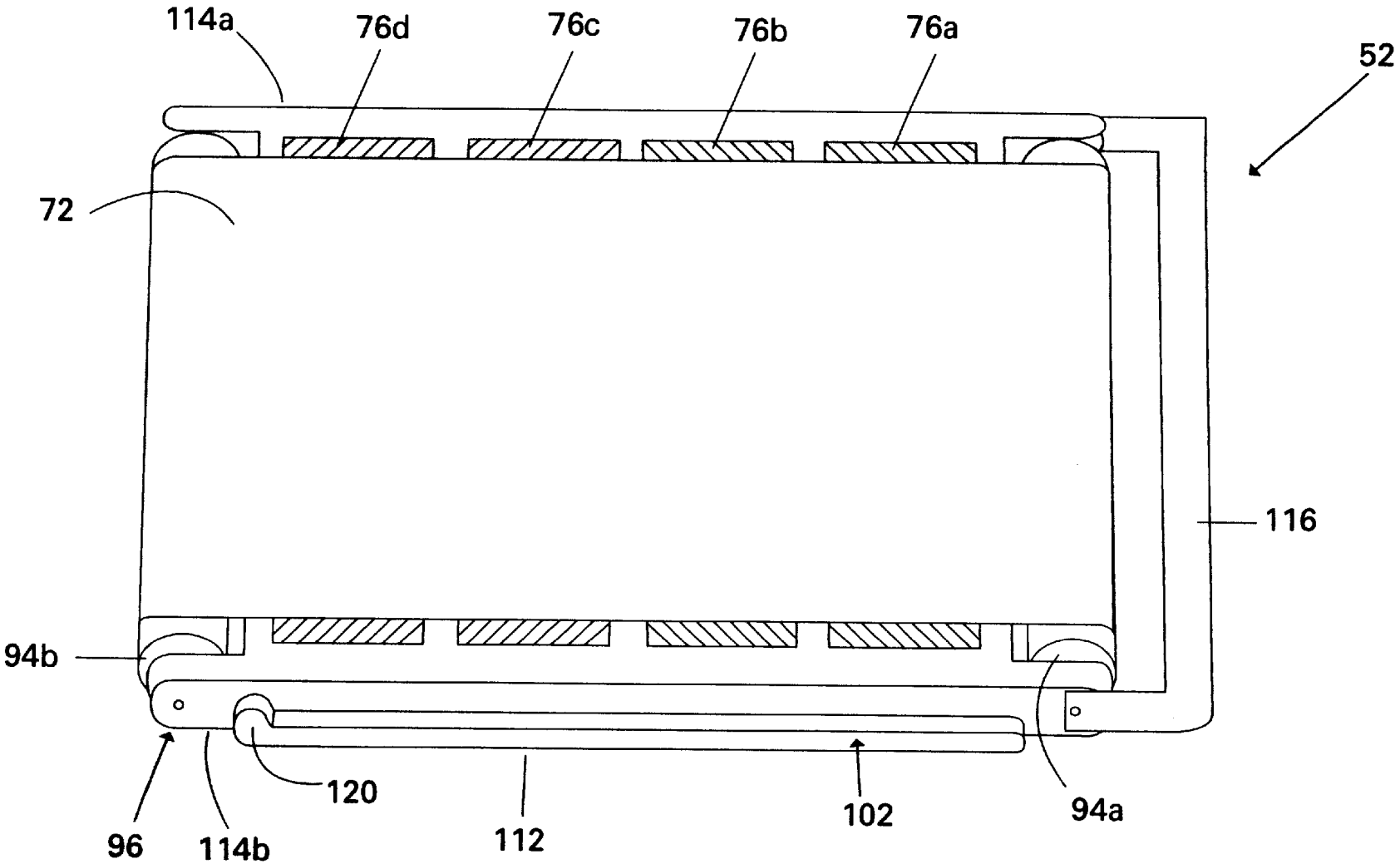
FIG. 1 is a top plan view of a releasably removable image receiving module.

While the present invention may be embodied in many different forms, there is shown in the drawings and discussed herein a few specific embodiments with the understanding that the present disclosure is to be considered only as an exemplification of the principles of the invention and is not intended to limit the invention to the embodiments illustrated.

The invention includes a novel imaging system with its removable image receiving module. The system and module provide for easier upgradeability, downgradeability and simpler repair. As a result, color electrophotographic systems may be more within the financial reach of small businesses. Additionally, the releasably removable cartridge may also provide for quicker repair (or even replacement) via a remote service center.

Figure 2:
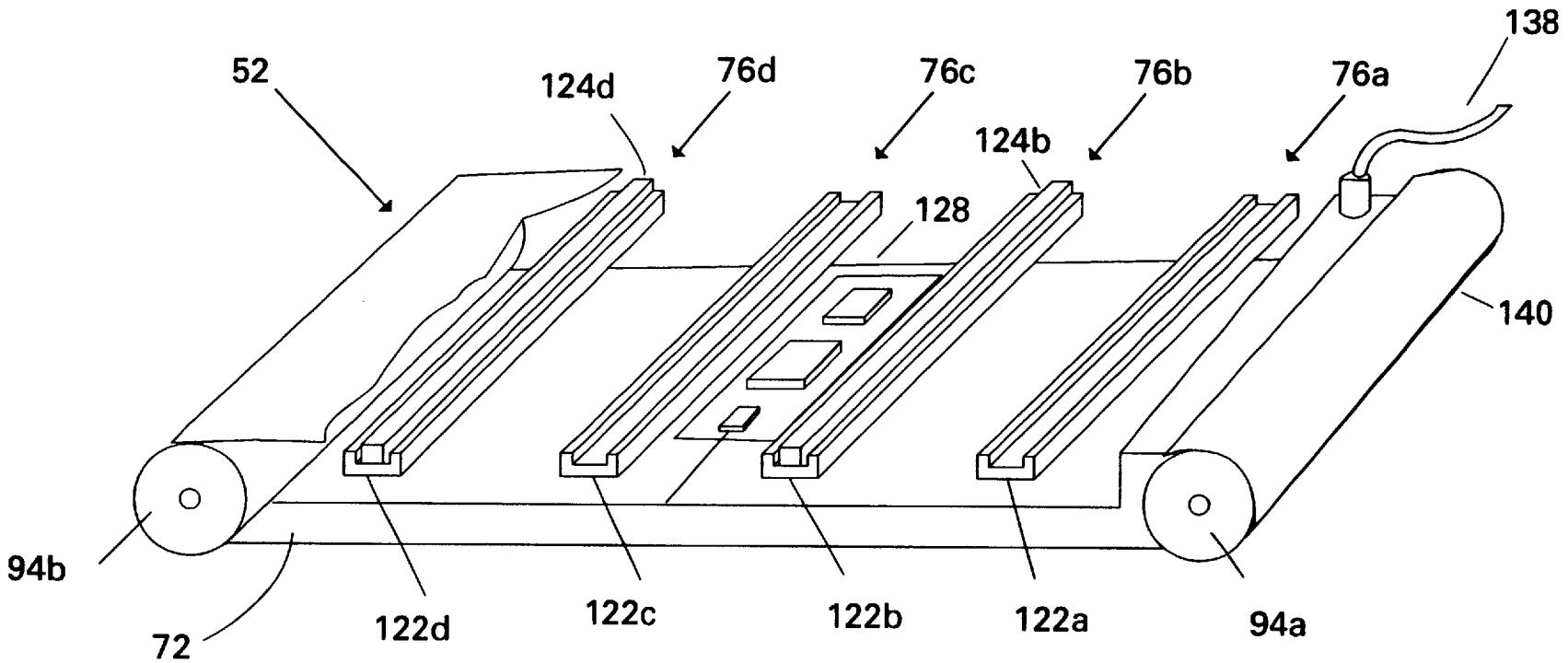
FIG. 2 is a break-away perspective view of the releasably removable image receiving module of FIG. 1.

As shown in FIGS. 1 and 2, the releasably removable image receiving module 52 includes an image receiving substrate 72 supported by a frame assembly 96. In this particular example, the image receiving substrate 72 is a belt-type photoreceptor. Image receiving substrate may alternatively be a drum-type photoreceptor. In the example of FIGS. 1 and 2 the frame assembly 96 includes a first roller 94*a*, a second roller 94*b*, a top frame 114*a*, and a bottom frame 114*b*. Additionally, the releasably removable image receiving module 52 includes exposure regions 76*a*, 76*b*, 76*c* and 76*d*.

As shown in FIG. 2, disposed on the frame assembly is a module support structure 72. The module support structure 72 includes exposure unit mounting brackets 122*a*, 122*b*, 122*c* and 122*d*. In the example shown in FIG. 2, two exposing units 124*b* and 124*d* are releasably engaged by brackets 122*b* and 122*d*, respectively. The exposing units 124 may be lasers, light-emitting diodes or "LED" printer heads ("LPHs"). In each case, each exposing unit is selectively actuated to project light corresponding to an image corresponding to one color at a time to discharge electrostatic charge on the image receiving substrate 72 at desired locations on its surface to produce a latent image. As shown in FIG. 2, the releasably removable image receiving module 52 is powered via releasably removable power cord 138, which forms a make and break connection 140 (shown in FIG. 4) with the module 52, as is well known in the electrical art.

The releasably removable image receiving module 52 is designed to accept from one to four exposing units at a time. With one exposing unit mounted in a respective exposure unit mounting bracket, the releasably removable image receiving module 52 can be used to print monochrome images in one rotation of the image receiving substrate or full color images (using four subtractive colored images (e.g. yellow, magenta, cyan and black)) in four passes. Similarly, with two exposing unit mounted in respective exposure unit mounting brackets, the releasably removable image receiving module 52 can be used to print full color images (using an additive tone-on-tone color scheme) in two passes. In the example shown in these figures, the maximum number of units corresponds to the number of toner colors used in the standard electrophotographic four subtractive color scheme known in the art and used in many color electrophotographic units. Of course, in a system utilizing a different color generation scheme, the number of exposure unit mounting brackets (and, in turn, exposure units) may be varied, as would be understood by those of skill in the art having the present disclosure before then.

It follows from these examples that the fewer number of exposing unit included in the module 52 the more time required to develop a four color subtractive image on the image receiving substrate. Conversely, the fewer exposing units, the lower the overall cost for the module 52 and, hence, the imaging system.

Figure 3:
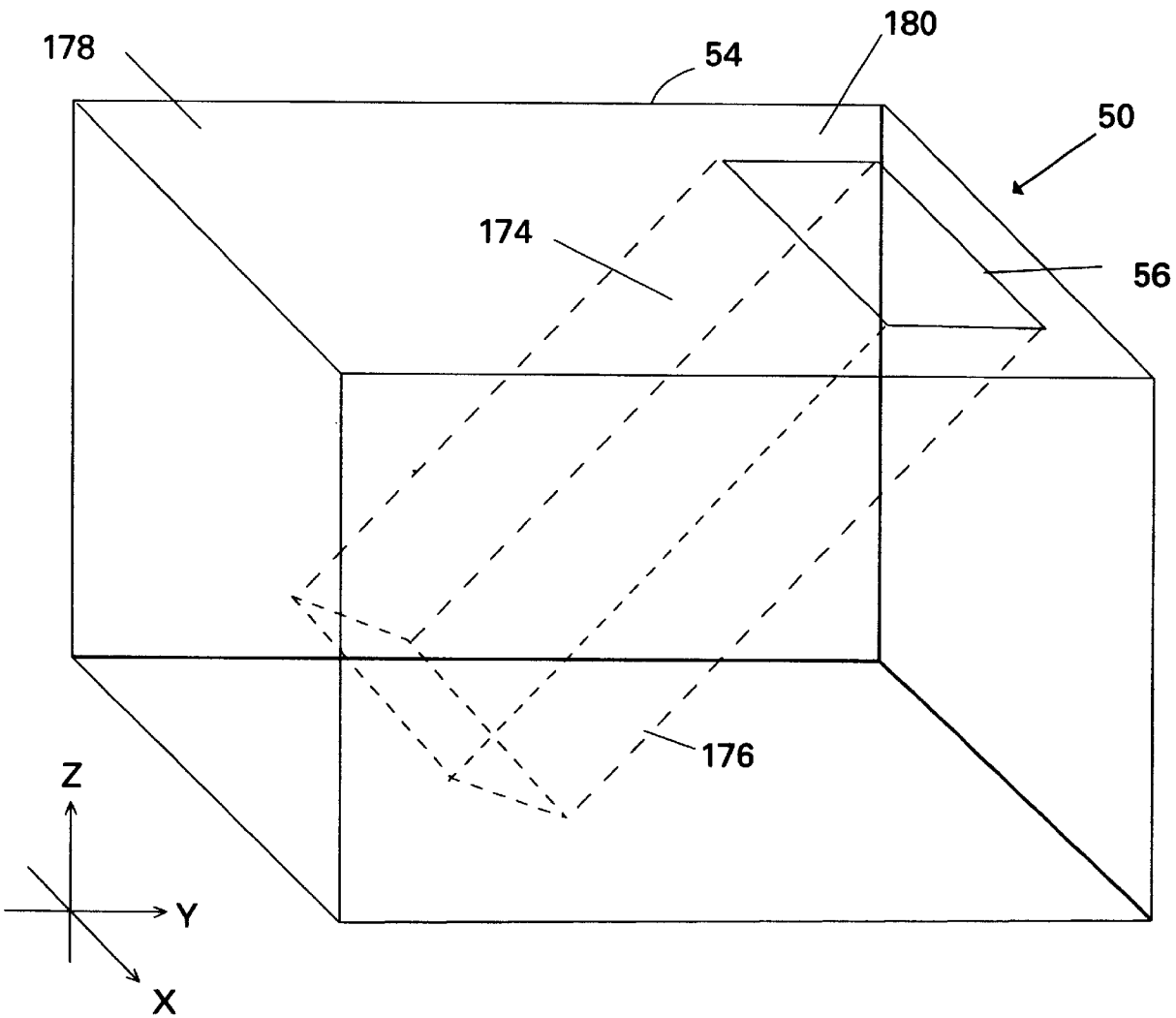
FIG. 3 is a graphical depiction of an electrophotographic apparatus configured to receive the releasably removable image receiving module of FIG. 1.
Figure 5:
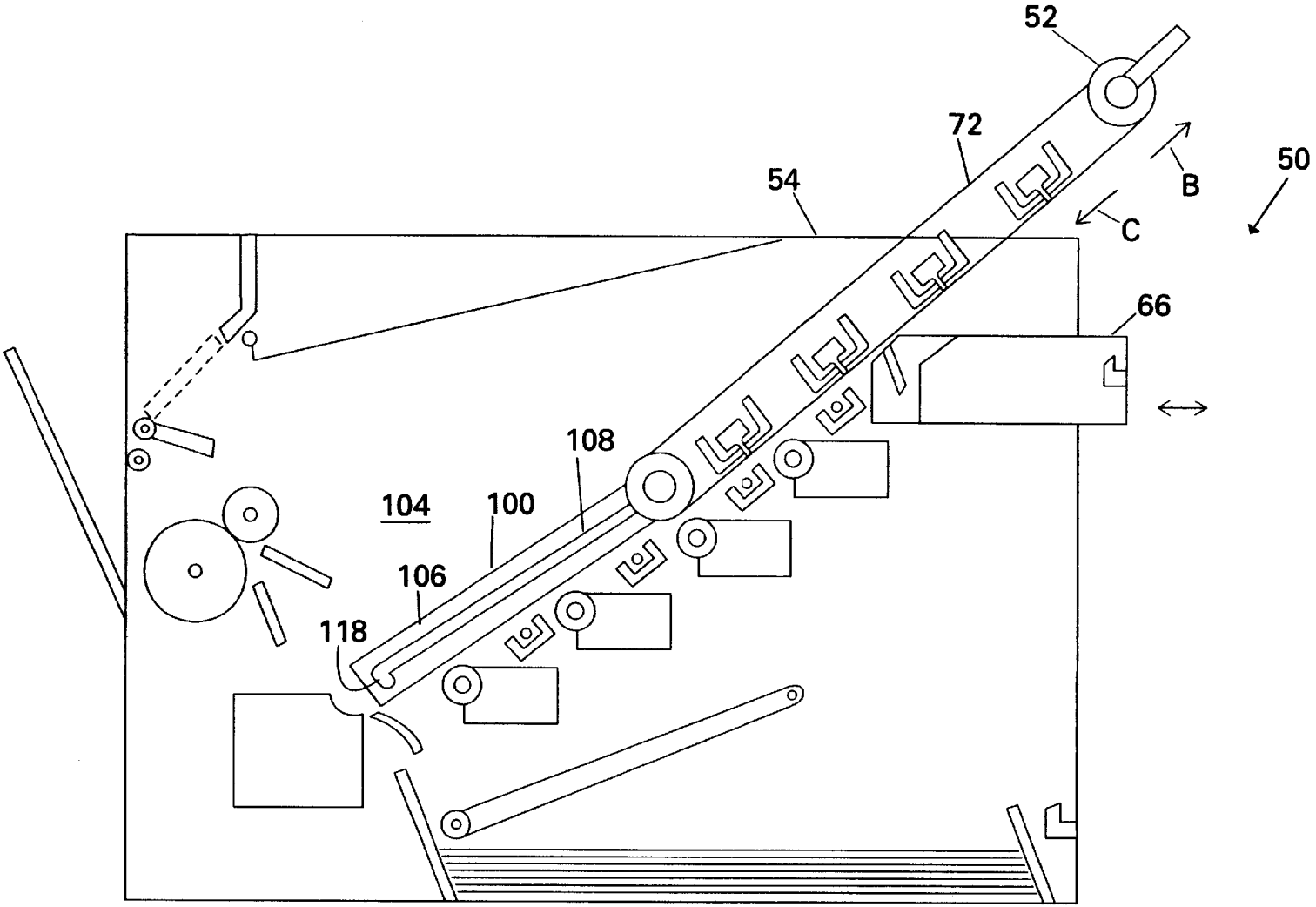
FIG. 5 is a cross-sectional side schematic view of one exemplary electrophotographic apparatus into which the releasably removable image receiving module of FIG. 1 may be inserted.
Figure 6:
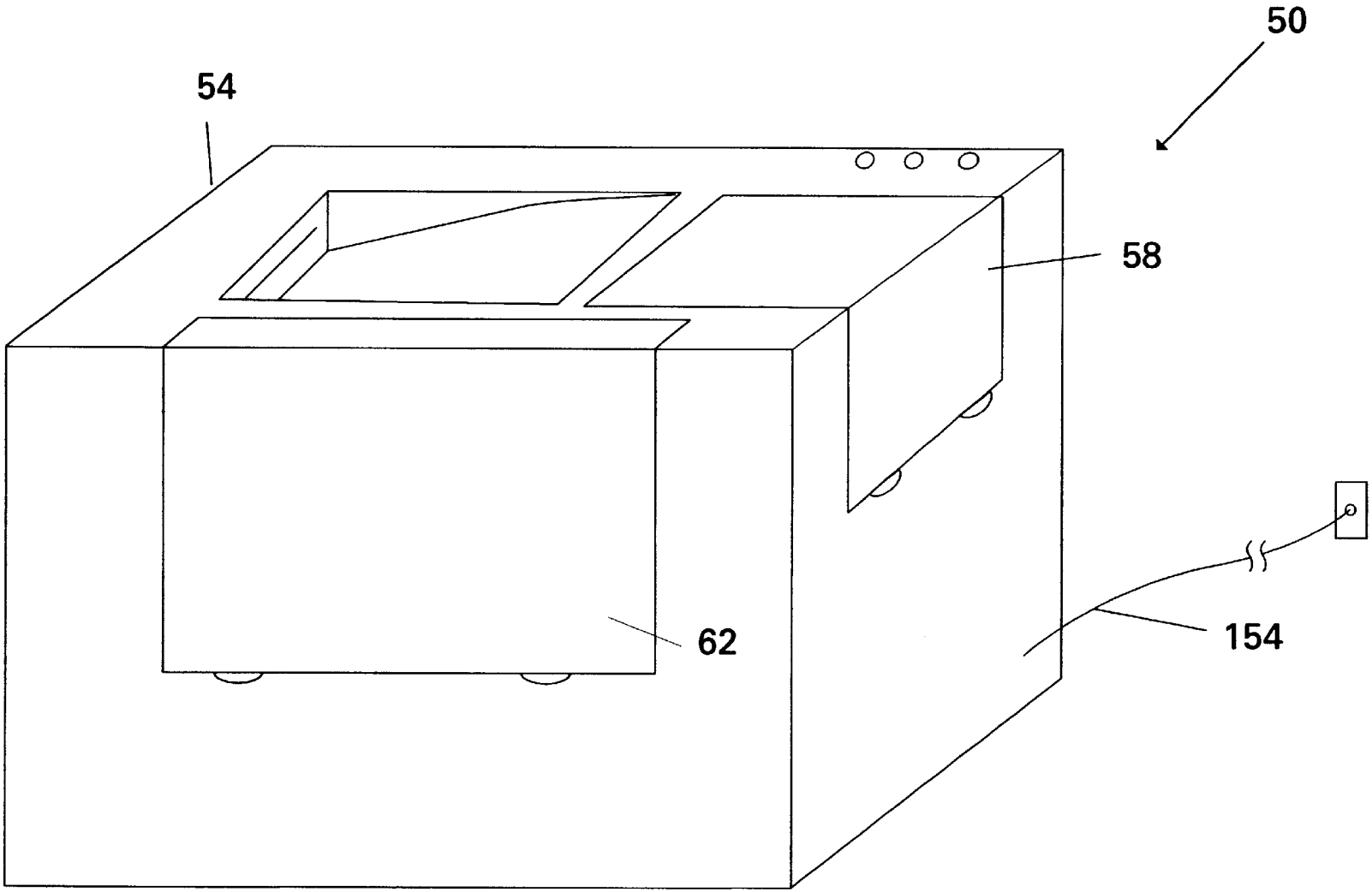
FIG. 6 is a side view of the exemplary electrophotographic apparatus of FIG. 5.

The frame assembly additionally includes a system engagement mechanism 102 (shown in FIG. 1) configured to be releasably engageable with a system support structure 100 mounted on an interior wall 104 of an imaging system 50 (shown in FIGS. 3, 5 and 6). In the example of FIGS. 1 and 5, the system engagement mechanism 102 includes slide member 112 with a bulbous engaging nub 120, which in turn releasably engage slot 108 and recess 118 on the imaging system 50.

Figure 4:
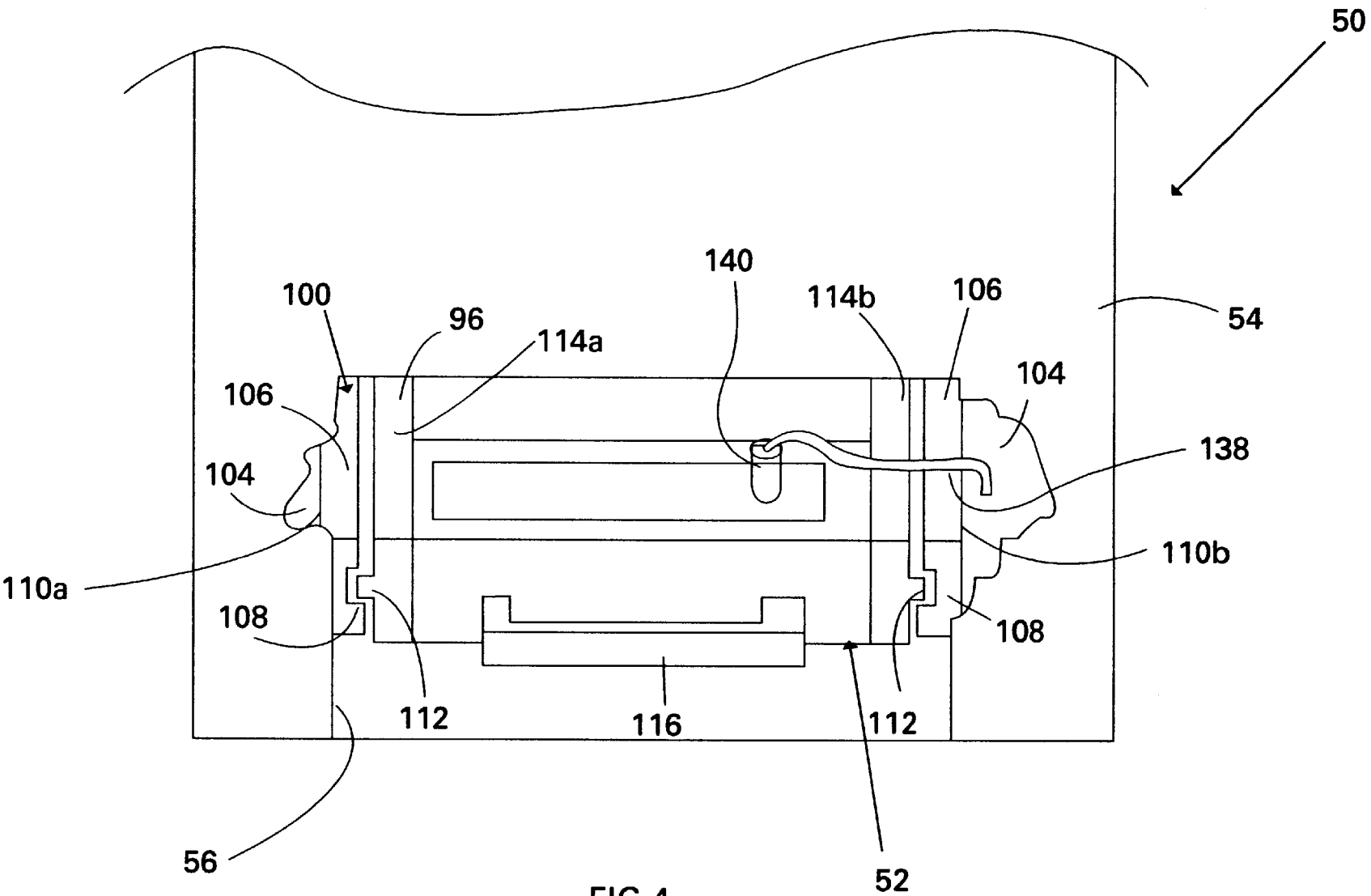
FIG. 4 is a partial top view of the graphical depiction of the electrophotographic apparatus of FIG. 3 with the releasably removable image receiving module of FIG. 1 inserted therein.

As shown in the example of FIGS. 3, 4 and 5, by grasping handle 116 (FIGS. 1, 4 and 5), the releasably removable image receiving module 52 can be moved in directions indicated by arrows B and C (FIG. 5) toward respectively, removing and inserting the module into the imaging system 50. In the particularly disclosed example, this involves lowering the module 52 as an angle into the housing 54 of the imaging system 50. The generalized case for this example is shown in FIG. 3 wherein the module 52 is inserted via opening 56 into an angular passageway formed within the imaging system bounded by top path 174 and bottom path 176 within which no permanent components of the imaging system may be placed such that the module 52 may freely be inserted and removed from the housing. The example of an angled passageway is not intended as a limitation. Rather, it should be understood to those of skill in the art having the present disclosure before them that imaging system 50 may be designed to have a horizontal, vertical or other angled passageway for insertion of the removable module 52 without departing from the spirit of this invention.

As depicted in FIG. 4, upon complete engagement within the system support structure 100 of the imaging system 50, nubs 112 will engage the slot 108, the bulbous engaging nub 120 will seat fully within recess 118, and the image receiving substrate 72 will consequently be disposed in an operative relationship with the imaging stations (shown in FIG. 5). As shown in FIG. 5, each of the four imaging stations include only a charger and a developer. The associatively operative exposure device for each imaging station is disposed within the releasably removable image receiving module 52. In the case of color imaging and only one inserted exposure unit, that single exposure unit is the associatively operative exposure device for each imaging station At the other end of the spectrum, in the present example, when four exposing units each imaging station will have its own associated exposure device.

As also shown in FIG. 5, the imaging system 50 includes a substrate supply tray containing substrates (e.g. paper or transparencies) that an image will be formed on. A conveying system removes the substrates from the supply tray and disposes each substrate between the image receiving substrate and a transfer charger whereupon the image is transferred to the substrate. The conveying system them moves the substrate to a fusing unit where the image is fixed and passed to an output tray (see FIG. 6). As further shown in FIG. 5, the imaging system includes a cleaning unit 66 that removes any residual developer from the surface of the image receiving substrate 72. This cleaning unit 66 is necessarily removable from the housing to dispose of the accumulated residual developer.

In the example of FIG. 2, module support structure 72 also supports control means 128. Control means 128 may include a microprocessor and memory for use in controlling the imaging system 50 in accordance with the number of exposing units inserted in the receiving module. The memory may provide general-purpose and/or application specific storage such as a read only memory "ROM," random access memory "RAM," or equivalent type storage unit. The control means 128 may utilize the information from the memory to determine the number of passes that the image receiving substrate must make past the imaging stations to form a complete image.

In this manner, the releasably removable image receiving module 52 can be used to upgrade or downgrade the imaging system. In particular, the imaging system can be upgraded by providing the releasably removable image receiving module 52; determining the number of exposing units 124 in the releasably removable image receiving module 52; and inserting at least one additional exposing unit 124 in the releasably removable image receiving module. Similarly, the imaging system can be downgraded by providing the releasably removable image receiving module 52; determining the number of exposing units 124 in the releasably removable image receiving module; and removing at least one additional exposing unit 124 in the releasably removable image receiving module. In either instance, the control means 128 would be updated to reflect the number of exposure units actually seated in a functional manner within the releasably removable image receiving module 52.

In this manner, the releasably removable image receiving module 52 can also be used to modify the imaging system. In particular, by providing two releasably removable image receiving modules, the first releasably removable image receiving module 52 can be replaced by a second releasably removable image receiving module (not shown). In this manner, a malfunctioning imaging system may be quickly upgraded or downgraded or even potentially repaired (particularly if the failure is associated with the releasably removable image receiving module). As the photoreceptor, support structure and exposure units are disposed on the releasably removable image receiving module 52 it may be more likely that the failure is associated with the removable module. Of course, as more components are disposed within the module the probability that the failing component is removed with the module increases.

FIG. 6 shows the exemplary electrophotographic apparatus ("imaging system") that utilizes the releasably removable image receiving module 52. The imaging system 50 may be a printer (monocolor or multicolor), copier (monocolor or multicolor), facsimile machine (monocolor or multicolor) or any device that is a combination of these devices. The imaging system 50 includes the housing 54 with top access panel 58 and side access panel 62. As disclosed in the exemplary embodiment, by opening top access panel 58, the user can fully access the releasably removable image receiving module 52 toward removing same from the housing 54. Similarly, the user can fully access the developer units by opening side access panel 62. By so doing, the user can replentish toner. The imaging system 50 may be operably connected to the Internet by way of connection 154. By way of this connection, the photocopier manufacturer, distributor or repair agency may communicate with the imaging system 50 toward determining, among other things, the present configuration of the releasably removable image receiving module 52.

The foregoing description and drawings merely explain and illustrate the invention. Those of skill in the art who have the present disclosure before them will be able to make modifications and variations therein without departing from the scope of the present invention.

What is claimed is:

1. An imaging system comprising:

a plurality of developing stations for developing an image on a sheet;

a releasably removable image receiving module having an image receiving substrate and a plurality of exposing unit mounting elements, each of the plurality of exposing unit mounting elements capable of receiving an individually removable exposing unit; and a support structure for receiving the releasably removable image receiving module, releasably removable image receiving module being configured to be engageable with the support structure and the image receiving substrate being disposed in an operative relationship with the developing stations when the releasably removable image receiving module is engaged with the support structure.

2. The invention according to claim 1 wherein the image receiving substrate is a substantially transparent photoreceptor.

3. The invention according to claim 2 wherein the image receiving substrate is formed as a belt.

4. The invention according to claim 2 wherein the image receiving substrate is formed as a drum.

5. The invention according to claim 1 wherein the exposing unit comprises a LED array.

6. The invention of claim 1 wherein the releasably removable image receiving module further includes at least one individually removable exposing unit mounted on a respective one of the plurality of exposing unit mounting elements.

7. A method for upgrading an imaging system, the imaging system including at least one developing station and having a support structure, the method comprising:

providing a releasably removable image receiving module having at least one exposing unit and an image receiving substrate, the releasably removable image receiving module being configured to be engageable with the support structure such that the image receiving substrate is disposed in an operative relationship with the at least one developing station when the releasably removable image receiving module is engaged with the support structure;

determining the number of exposing units in the releasably removable image receiving module; and inserting at least one additional exposing unit in the releasably removable image receiving module.

8. A method for downgrading an imaging system, the imaging system including at least one developing station and having a support structure, the method comprising:

providing a releasably removable image receiving module having at least one exposing unit and an image receiving substrate, the releasably removable image receiving module being configured to be engageable with the support structure such that the image receiving substrate is disposed in an operative relationship with the at least one developing station when the releasably removable image receiving module is engaged with the support structure;

determining the number of exposing units in the releasably removable image receiving module; and removing at least one additional exposing unit in the releasably removable image receiving module.

9. A releasably removable image receiving module for an imaging system, the imaging system including a system frame with system support structure and at least one developing station having a charging unit and a developing unit, the releasably removable image receiving module comprising:

a frame assembly;

a module support structure, disposed on the frame assembly and configured to be releasably engageable with the system support structure of the imaging system; the module support structure having a plurality of exposing unit mounting elements, each of the plurality of exposing unit mounting elements capable of receiving an individually removable exposing unit; and an image receiving substrate supported by the frame assembly, the image receiving substrate being disposed in an operative relationship with the imaging stations when the module support structure is engaged with the system support structure.

10. The invention according to claim 9 wherein the image receiving substrate is a substantially transparent photoreceptor.

11. The invention according to claim 10 wherein the image receiving substrate is formed as a belt.

12. The invention according to claim 10 wherein the image receiving substrate is formed as a drum.

13. The invention according to claim 9 wherein the exposing unit comprises a LED array.

14. A method for modifying an imaging system, the method comprising:

providing an imaging system including:

a plurality of developing stations;

a first releasably removable image receiving module including an image receiving substrate having a plurality of exposing unit mounting elements, each of the plurality of exposing unit mounting elements capable of receiving an individually removable exposing unit; and a support structure for receiving the first releasably removable image receiving module;

the first releasably removable image receiving module being configured to be engageable with the support structure; and the image receiving substrate being disposed in an operative relationship with the developing stations when the first releasably removable image receiving module is engaged with the support structure;

providing a second releasably removable image receiving module including an image receiving substrate having a plurality of exposing unit mounting elements, each of the plurality of exposing unit mounting elements capable of receiving an individually removable exposing unit; and the second releasably removable image receiving module being configured to be engageable with the support structure; and removing the first releasably removable image receiving module from the imaging system; and inserting the second releasably removable image receiving module into the imaging system.

* * * * *